US007167135B2

(12) United States Patent
Kipnis et al.

(10) Patent No.: US 7,167,135 B2
(45) Date of Patent: Jan. 23, 2007

(54) MEMS BASED TUNABLE ANTENNA FOR WIRELESS RECEPTION AND TRANSMISSION

(75) Inventors: Issy Kipnis, Berkeley, CA (US); Valluri Rao, Saratoga, CA (US); Balakrishnan Srinivasan, Portland, OR (US); Joe Hayden, III, San Francisco, CA (US)

(73) Assignee: Intel Corporation, Santa Clara, CA (US)

( * ) Notice: Subject to any disclaimer, the term of this patent is extended or adjusted under 35 U.S.C. 154(b) by 104 days.

(21) Appl. No.: 10/877,456

(22) Filed: Jun. 25, 2004

(65) Prior Publication Data

US 2005/0057399 A1 Mar. 17, 2005

Related U.S. Application Data

(60) Provisional application No. 60/502,466, filed on Sep. 11, 2003.

(51) Int. Cl.
*H01Q 9/00* (2006.01)

(52) U.S. Cl. ..... 343/749; 343/700 MS

(58) Field of Classification Search ..... 343/749, 343/700 MS; 333/17.1; 455/84
See application file for complete search history.

(56) References Cited

U.S. PATENT DOCUMENTS

| | | | | |
|---|---|---|---|---|
| 4,462,009 | A * | 7/1984 | Landt et al. | 333/17.1 |
| 5,136,225 | A * | 8/1992 | Heddebaut et al. | 318/587 |
| 6,355,534 | B1 | 3/2002 | Cheng et al. | |
| 6,593,672 | B1 * | 7/2003 | Ma et al. | 307/109 |
| 6,952,565 | B1 * | 10/2005 | Takeda et al. | 455/84 |

OTHER PUBLICATIONS

Clark T.-C. Nguyen, "Communications Applications of Microelectromechanical Systems," Proceedings, 1998 Sensors Expo, San Jose, CA, May 19-21, 1998, pp. 447-455.

* cited by examiner

*Primary Examiner*—Trinh Dinh
*Assistant Examiner*—Huedung Mancuso
(74) *Attorney, Agent, or Firm*—Kevin A. Reif

(57) ABSTRACT

An antenna for a wireless device may be kept dynamically tuned to a desired center frequency to compensate for detuning which may be caused by environmental influences. A sensor provides a feedback signal to a controller to select an appropriate capacitance value from a variable capacitor to tune the antenna for the wireless device. The variable capacitor may comprise a plurality of fixed capacitors and MEMS switches arranged in parallel or may comprise a variable MEMS capacitor having a fixed lower plate and a flexible upper plate.

13 Claims, 3 Drawing Sheets

MEMS BASED TUNABLE ANTENNA FOR WIRELESS RECEPTION AND TRANSMISSION

CROSS-REFERENCE TO RELATED APPLICATION

This application claims priority to U.S. Provisional Application Ser. No. 60/502,466, filed on Sep. 11, 2003, the contents of which are herein incorporated by reference.

FIELD OF THE INVENTION

Embodiments of the present invention relate to antennas and, more particularly, to MEMS (micro-electromechanical systems) tunable antennas.

BACKGROUND INFORMATION

No longer are electronic communication devices necessarily tethered by wires. In recent times wireless communications has become a popular and often an economical and convenient method by which to communicate both analog and digital information. In particular, cellular phones and other mobile communication devices such as personal digital assistants (PDAs), palm, and lap-top computing devices connect to service providers via wireless links.

Such wireless devices rely on antenna technology to radiate radio frequency (RF) signals for transmission (Tx) as well as to gather RF broadcast signals for reception (Rx). Often the same antenna or antenna array performs both of these transmit and receive functions. While antennas may be one of the most vital elements in a wireless system, they may be one of the most inefficient elements, typically accounting for a large portion of energy loss.

As the effort to shrink the size of mobile devices such as cell phones continues, efforts are being made to reduce the size of the antenna. To further compound this effort, modern cell phones may be designed to work with dual/triple/quad bands for Tx/Rx. Given the size considerations, it may be difficult to have a dedicated antenna to operate in each frequency band. For example, FIG. 1 shows the frequency range of the Global System for Mobile Communication (GSM) 850 and GSM 900 bands which together span about 824 MHz to 960 MHz (megahertz). GSM is currently the dominant digital mobile phone standard for much of the world. As shown, GSM 850 utilizes 25 MHz each for Tx and Rx, and GSM 900 utilizes 35 MHz each for Tx and Rx. The GSM protocol dictates the way that mobile phones communicate with the land-based network of cell towers. Modern mobile communication devices thus call for a small antenna that can efficiently operate over such a broad range.

The efficiency of so called microstrip or "patch antennas", which are often used in cellular phone applications can fluctuate dramatically depending on its usage. For example, the radiation efficiency can fluctuate from 80% down to 15% or lower depending the positioning of the antenna and surrounding environment. Environmental considerations include not only geographical terrain, but also more dynamic factors such as the phone is sitting on a table, held the user's hand, near the user's head, inside of a car, etc. Further, for any given wireless session the antenna may encounter all of these obstacles as the user constantly repositions the phone and thus repositions the antenna. A major cause of these fluctuations may be due to detuning of the center frequency of the antenna caused by additional capacitive loading from the environment.

DETAILED DESCRIPTION

Figure 2:
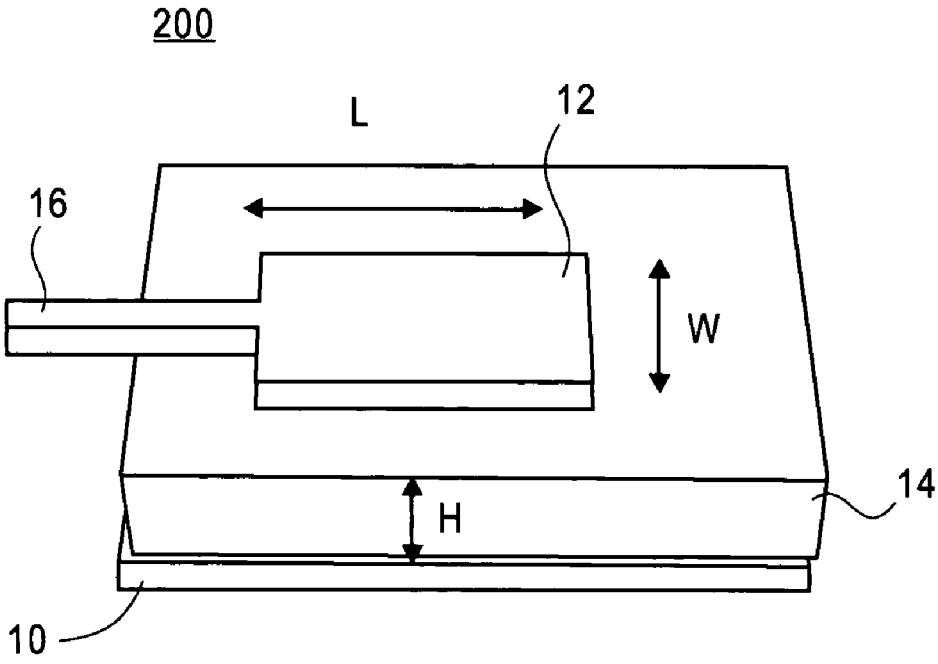
FIG. 2 is a plan view of a patch antenna for a for a wireless device such as a cellular telephone.

Referring now to FIG. 2, there is shown a patch antenna 200 that may be used in a mobile device, such as a cellular phone. A patch antenna 200 comprises two conducting plates, 10 and 12, sandwiching a dielectric material 14, and may be built in a similar way as a parallel plate capacitor. In the case of an antenna, the bottom conducting plate 10 may be referred to as the "ground plate", and the top conducting plate 12 may be referred to as the "patch". The patch 12 may comprise a thin metal foil such as copper or aluminum and may be smaller than, and centered over, the ground plate 10. An antenna feed 16 may connect to one side of the patch 12. The ground plate 10, the patch 12, and feed 16 may be made of the same conducting material. The dielectric material 14 may be, for example silicon, alumina, or a printed circuit board laminate such as FR-4.

While the patch may be any shape, for simplicity of illustration it is shown as a square or rectangular. The size of the patch 12 may be chosen relative to the frequency in which the antenna is to operate where antenna bandwidth is proportional to the antenna volume, length (L)×width (W)×height (H), (L×W×H). Antenna efficiency and quality or "Q-factor" are two metrics for qualifying the antenna design. Antenna efficiency may be designated by the symbol "$\eta$", where $\eta$ equals power radiated/input power. The Q-factor is generally understood to mean the ratio of the stored energy to the energy dissipated per radian of oscillation and may be used to describe antennas and other inductive or capacitive devices. For patch antennas the Q-factor depends on several factors which are determined not only by the materials in the antenna (metals and dielectrics) but also geometry of the antenna and its surrounding environment.

Figure 1:
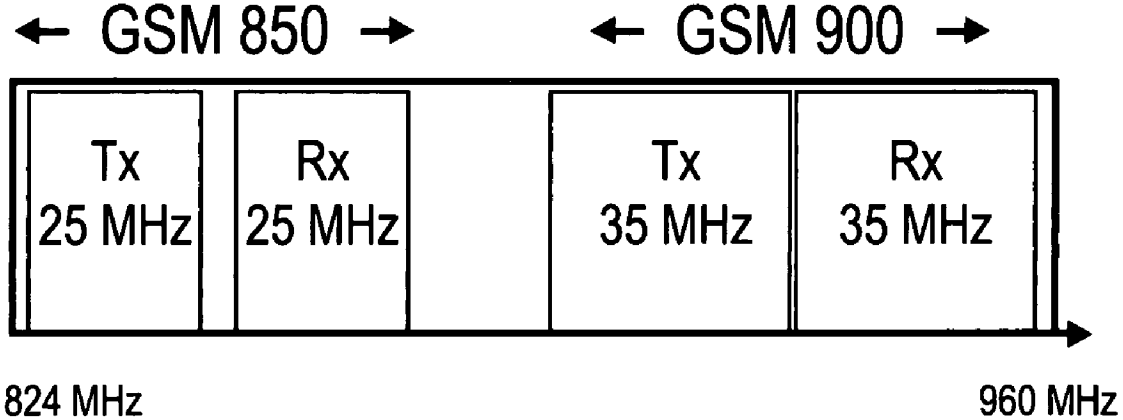
FIG. 1 is an illustrative representation of the frequency response for a wireless device antenna tuned to operate across the GSM 850 and GSM 900 range.
Figure 3:
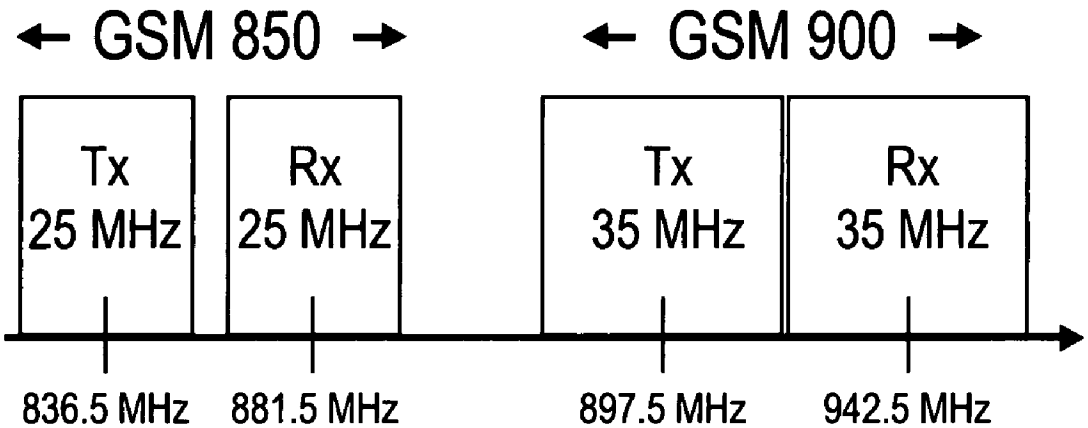
FIG. 3 is an illustrative representation of the frequency response for a wireless device antenna dynamically tunable to the center frequencies of the Tx and Rx bands within the GSM 850 and GSM 900 range.

According to embodiments of the invention, the center frequency of an antenna may be tuned such as by using a variable MEMS capacitor or varactor. As shown in FIG. 3, an antenna may be tuned to the center frequencies of the Tx and Rx ranges for either the GSM 850 or GSM 900 bands. As shown, for GMS 850 the center frequency for Tx is 836.5 MHz and the center frequency for Rx is 881.5 MHz. Similarly, for the GSM 900 band, the center frequency for Tx is 897.5 MHz and the center frequency for Rx is 942.5 MHz. For example, by changing a capacitive load, a single antenna may be tuned to a variety of center frequencies even in different bands. Further, the tuning may be adjusted dynamically to maintain tuning locked on the center frequency even as the capacitive loading due to the environment changes (e.g., as the antenna is moved and repositioned during use).

Figure 4:
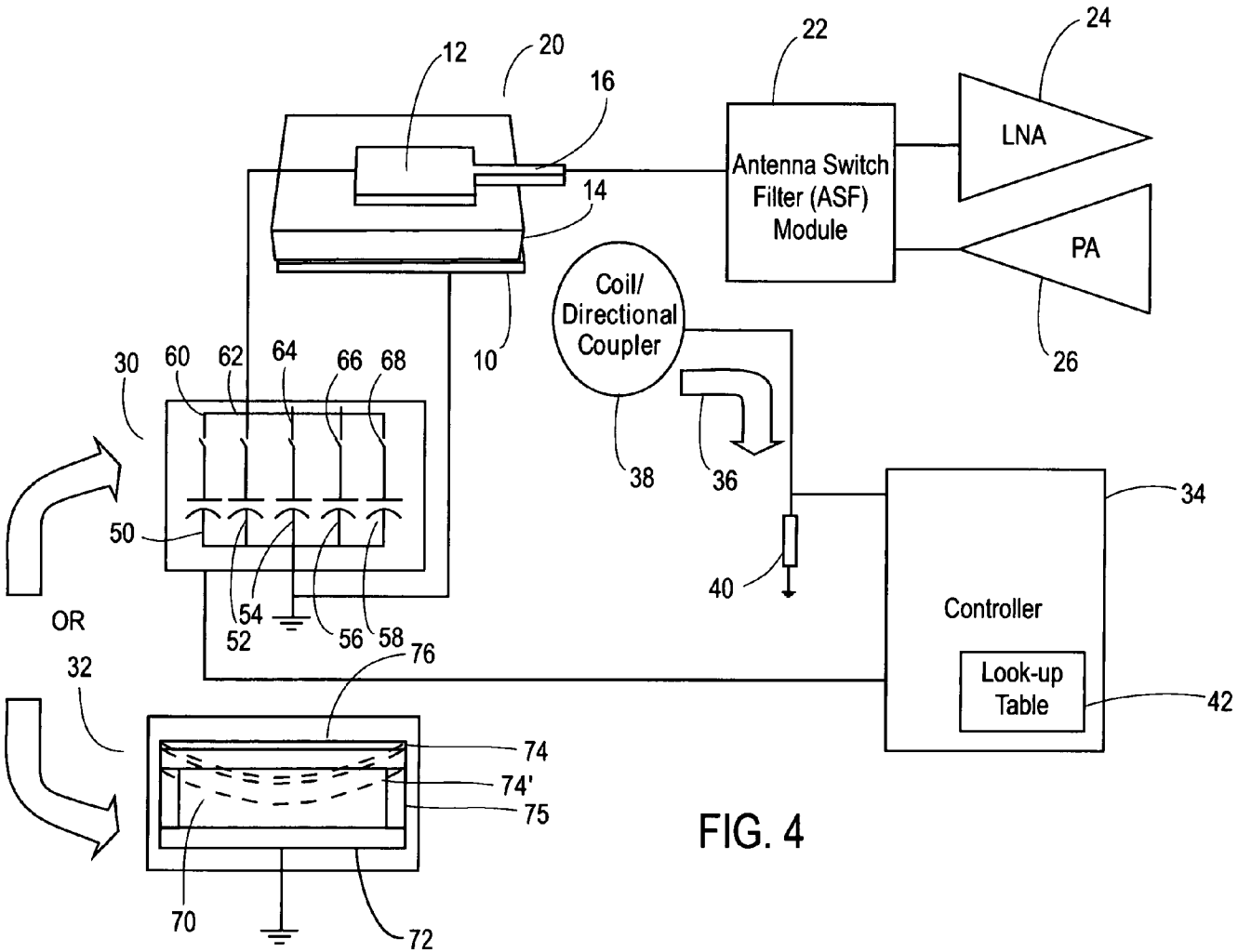
FIG. 4 is a block diagram of a dynamically tunable antenna.

Referring now to FIG. 4, there is shown an exemplary tunable antenna design in accordance with an embodiment of the invention. The antenna 20 may be a patch antenna as discussed above. The antenna 20 may include the bottom plate or "ground" plate 10 and a top conducting plate or "patch" 12. The patch 12 may comprise a thin metal foil such as copper or aluminum and may be smaller than, and centered over, the ground plate 10. An antenna feed 16 may connect to one side of the patch 12.

An antenna switch filter (ASF) module 22 switches the antenna 20 between a low noise amplifier (LNA) 24 for transmission (Tx) and a power amplifier (PA) 26 for reception (Rx). The ASF module 22, LNA 24, and PA 26 may comprise a front end module of a cell phone for example or other wireless device.

As previously noted, the antenna 20 may be initially tuned to various center frequencies as well as adjusted in real time to maintain a desired center frequency by adjusting the capacitive load to compensate for environmental loading. FIG. 4 shows two types of variable capacitive modules 30 and 32, discussed in greater detail below, for altering the capacitive load to the antenna. The variable capacitive module, 30 or 32, connects between the ground plate 10 and patch 12 of the antenna 20.

A controller 34 connects to the capacitive module, 30 or 32, to select a proper capacitance to initially tune the antenna 20 to a desired center frequency such as, for example, those shown in FIG. 3. A feedback loop 36 comprising a sensor 38 that measures the radiated power, which may be a pick-up coil or directional coupler, and a power detector 40, continuously measures the near field radiated power from the antenna 20 to provide the appropriate tuning corrections. The controller 34 may use a Fourier transform to correlate the detected near field to a far field measurement to closely approximate the current tuning frequency of the antenna 20. Alternatively the power delivered to the antenna 20 (which is not necessarily the same amount that is radiated) may be used to approximate the radiated power to simplify the monitoring. For example, the power amplifier 26 may provide a signal that is proportional to delivered power. The controller 34 may then compare this to the desired tuning frequency for the antenna 20 to determine a drift from the desired center frequency. The controller 34 may then adjust the capacitive load via the variable capacitive module 30 or 32. The appropriate capacitance of the variable capacitive module 30 or 32 to produce the desired tuning of the antenna 20 may be calculated by the controller 34 or accomplished by, for example, a look-up table 42 within the controller 34.

Thus, as the antenna 20 is constantly detuned due to external factors such as repositioning of the host wireless device with respect to the surrounding environment, embodiments of the invention may continuously compensate in real time to keep the antenna 20 tuned to a desired center frequency.

Still referring to FIG. 4, various variable capacitor schemes may be used. In one embodiment, the variable capacitor module 30 comprises a bank of high-Q capacitors, 50, 52, 54, and 58 connected in parallel, each of which may have a different fixed capacitive value. Each of the capacitors 50, 52, 54, and 58 may be switched on or off by a MEMS switch 60, 62, 64, 66, or 68, respectively. A MEMS switch may be preferred to a solid state-switch since solid state switches are generally non-linear devices which create undesirable frequency sidebands which can interfere with other wireless devices.

As shown, the variable capacitor module 30 comprises a bank of five fixed capacitors 50–58 and associated MEMS switches 60–68. The capacitors 50–58 may for example have values of 1 pF (picofarad) to 5 pF, respectively. By selecting one of more of the MEMS switches to close, a wide range of variable capacitance values may be realized to keep the antenna 20 tuned to a desired center frequency. This is of course by way of example only as more or less than five capacitors may be used and the capacitive value of each may comprise different values than those offered.

In another embodiment, the variable capacitive module 32 may comprise a variable MEMS parallel plate capacitor 70 where one plate is made to move to change the capacitance value. Variations of suitable variable MEMS capacitors may be found with reference to U.S. Pat. No. 6,355,534 to Ma et al. and U.S. Pat. No. 6,593,672 to Cheng et al. As shown the variable capacitor 70 may comprises a fixed charge plate 72, a movable charge plate 74 disposed above the fixed charge plate 72 by spacers 75. A stiffener 76 may be affixed to the movable charge plate 74. In operation, when an actuation voltage is applied to the variable MEMS capacitor, such as by the controller 34, the moveable charge plate 72 is caused to flex in a downward direction, illustrated by dashed lines as movable charge plate 74'. In this manner the MEMS capacitor may produce a continuous range of variable capacitance values the proper value of which may be selected to tune the antenna 20 to the desired center frequency.

According to embodiments of the invention, the antenna 20 may be switched to multiple desired center frequencies and thereafter continuously monitored and tuned to maintain the desired frequency to facilitate higher antenna efficiency. Power may be efficiently radiated under changing environmental conditions as opposed to being dissipated promoting longer battery life and improved range.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus, comprising:

an antenna;

a variable capacitor module operatively connected to the antenna;

a sensor in proximity to the antenna to detect antenna radiated power; and a controller to receive a signal from the sensor to vary a capacitance of the variable capacitor module to tune the antenna to a desired center frequency, wherein the variable capacitor module comprises:

a fixed plate and flexible plate separated a distance from the fixed plate, wherein the distance may be varied in response to a control voltage applied between the fixed plate and the flexible plate.

2. The apparatus as recited in claim 1 wherein the antenna comprises a patch antenna.

3. The apparatus as recited in claim 2 wherein the sensor comprises one of a coil and a directional coupler arranged in a feed-back loop.

4. The apparatus as recited in claim 3 further comprising a look-up table to determine the capacitance of the variable capacitor module for the desired center frequency.

5. A method, comprising:

tuning an antenna to a desired frequency by varying a capacitance of a variable capacitor module;

positioning a sensor in proximity to the antenna to produce a feed-back signal to indicate a drift from the desired frequency; and varying a capacitance value of the variable capacitor module to maintain the antenna tuned to the desired frequency, wherein dynamically varying the capacitance value, comprises:

supplying an actuation voltage to a micro-electromechanical system (MEMS) capacitor causing an upper plate to flex towards a lower plate.

6. The method as recited in claim 5 further comprising: converting a near field signal from the feed-back loop to a far field signal with a Fourier transform.

7. The method as recited in claim 6, further comprising: using the far field signal to determine an actuation voltage to change the capacitor value of a micro-electromechanical system (MEMS) capacitor.

8. The method as recited in claim 6, further comprising: using the far field signal to determine ones of a plurality of micro-electromechanical system (MEMS) switches to active to change the capacitor value of a bank of parallel connected fixed capacitors.

9. An apparatus comprising:

an antenna, a variable micro-electromechanical capacitor means to tune the antenna frequency;

a controller to operatively connected to the variable micro-electromechanical capacitor means to select a capacitance value to tune the antenna to a desired center frequency, wherein the variable micro-electromechanical capacitor means comprises a micro-electromechanical system (MEMS) capacitor comprising a fixed lower plate and a flexible upper plate.

10. The apparatus as recited in claim 9 further comprising:

means for determining a power level radiated from the antenna operatively connected to the controller to determine the real-time center frequency of the antenna.

11. The apparatus as recited in claim 10, wherein the means for determining power level comprises a sensor in proximity of the antenna arranged in a feed-back loop to the controller.

12. The apparatus as recited in claim 10, wherein the means for determining power level comprises a power amplifier delivering power to the antenna and a signal to the controller proportional to delivered power.

13. An antenna for a wireless system, comprising:

an antenna;

a variable capacitor module operatively connected to the antenna, wherein the variable capacitor module comprises a micro-electromechanical system (MEMS) capacitor comprising a fixed lower plate and a flexible upper plate;

a sensor in proximity to the antenna to detect antenna radiated power;

a controller to receive a signal from the sensor to vary a capacitance of the variable capacitor module to tune the antenna to a desired center frequency;

a power amplifier to supply a transmit (Tx) signal to the antenna; and an antenna switch filter (ASF) connected to switch the antenna between the power amplifier and a low noise amplifier.

* * * * *